United States Patent [19]

Looser

[11] Patent Number: 4,693,157

[45] Date of Patent: Sep. 15, 1987

[54] CUTTING DEVICE

[76] Inventor: Gottlieb Looser, In der Finne 910, 9496 Balzers, Liechtenstein

[21] Appl. No.: 703,216

[22] Filed: Feb. 19, 1985

Related U.S. Application Data

[63] Continuation of Ser. No. 298,632, Sep. 2, 1981, abandoned.

[30] Foreign Application Priority Data

Sep. 16, 1980 [CH] Switzerland ..... 6911/80

[51] Int. Cl.[4] ..... B26D 7/06

[52] U.S. Cl. ..... 83/431; 83/433; 83/856; 83/926 H

[58] Field of Search ..... 83/926 H, 561, 676, 83/856, 858, 433, 509, 506, 508, 369, 368, 105, 699, 56, 431; 30/347, 240, 49

[56] References Cited

U.S. PATENT DOCUMENTS

| | | | |
|---|---|---|---|
| 1,687,928 | 10/1928 | Castricum et al. | 242/56 R |
| 1,950,920 | 3/1934 | Gorna | 83/469 |
| 2,923,194 | 2/1960 | Ambler et al. | 83/926 H |
| 3,463,377 | 8/1969 | Lucas | 83/199 X |
| 3,522,753 | 8/1970 | Schmied | 83/561 X |
| 3,640,162 | 2/1972 | Fleming, Jr. | 83/433 X |
| 3,651,728 | 3/1972 | Young | 83/676 X |
| 3,695,131 | 10/1972 | Zimmermann | 83/431 X |
| 3,858,474 | 1/1975 | Kuts | 83/433 X |
| 4,120,223 | 10/1978 | Bosse | 83/433 X |
| 4,345,497 | 8/1982 | Cobleigh et al. | 83/856 |

FOREIGN PATENT DOCUMENTS

| | | | |
|---|---|---|---|
| 48052 | 3/1982 | European Pat. Off. | 83/856 |
| 495319 | 4/1930 | Fed. Rep. of Germany | 83/676 |
| 1454957 | 5/1969 | Fed. Rep. of Germany | 83/561 |
| 2140604 | 2/1973 | Fed. Rep. of Germany | 83/926 H |
| 1059760 | 2/1967 | United Kingdom | 83/433 |
| 1435080 | 5/1976 | United Kingdom | 83/676 |

*Primary Examiner*—William R. Briggs
*Attorney, Agent, or Firm*—Werner W. Kleeman

[57] ABSTRACT

For cutting polymer films, e.g. a continuously moving web of polymer film, there is accomplished relative movement between the film and a cutting edge which is a substantially continuous and generally razor-sharp edge located at the periphery of an indexing steel sheet disc having a generally circular shape and a thickness in the same order of magnitude as the thickness of the polymer film; after maintaining the disc in a first angular position where an incremental portion e.g. 1 to 10 degree of a 360° periphery, of the cutting edge is in film-cutting position for a period of cutting time, the disc is indexed and a subsequent incremental portion of the edge is moved into film-cutting position and held there for another period of cutting time. This is repeated until a major part and preferably all of the continuous edge has been indexed. Then, the disc is exchanged. When using an automated indexing actuator, e.g. a step-motor, and monitoring cutting time, the frequency of step-switching can be adapted to the periods of time during which the incremental edge portions of the indexing blade are in cutting position. Near completion of an indexing cycle, a signal is generated and a fresh blade is put into operation. As a consequence, a perfectly sharp edge portion of the indexing blade will be in film-cutting position at any time, thus providing for reliable cutting of the film, e.g. emerging as a tubular film from extrusion, even when highly abrasive films are processed.

14 Claims, 8 Drawing Figures

CUTTING DEVICE

CROSS REFERENCE TO RELATED APPLICATION

This application is a continuation of my copending U.S. application Ser. No. 06/298,632, filed Sept. 2, 1981 and entitled "Cutting Method And Device".

BACKGROUND OF THE INVENTION (1) Field of the Invention

This invention relates generally to processing of polymer films, notably in the form of continuously moving webs, and specifically to cutting of such films or webs, generally in continuous operation and in longitudinal or machine direction.

(2) Description of the Prior Art

Various machines used for continuous production or processing of polymer films, e.g. winders of the type disclosed in U.S. Pat. Nos. 1,687,928, 2,915,255, 3,949,566 and in my U.S. Pat. No. 4,191,341, may require a continuous cutting operation to be performed at the moving polymer web, generally at a marginal area thereof and in longitudinal direction (parallel to machine direction), e.g. for continuously opening a blown polymer film hose at its sides so as to produce two separate polymer webs that can be wound up separately. Further, a wider polymer web may require division into a number of parallel strips, or a web may require longitudinal side portions to be cut away, e.g. after coating, etc.

Any such longitudinal continuous cutting operation requires prolonged cutting of polymer films, generally at relatively high speeds, and dulling of the cutting edge must be prevented or controlled if undesired tearing or rupturing of the polymer film is to be prevented.

Another type of cutting operation associated with production or processing of polymer films is transverse (to machine direction) cutting, e.g. when a length of web has been wound-up on a mandrel and the continuous web must be cut to end winding on a previous mandrel and to start winding on another mandrel. It will be understood that transverse cutting requires relatively less actual cutting time of a knife but dulling may still be a problem, notably when the knife edge is in contact with the surface of a roller.

Broadly, four types of mechanical cutting modes can be distinguished in polymer film cutting:

(a) press cutting, i.e. when the cutting edge is pressed onto the polymer film which in turn is supported by a surface or anvil;

(b) shear cutting, i.e. when two cutting edges interact upon the polymer film in the manner of shear blades;

(c) rotational cutting, i.e. when a circular knife is rotated at high rotating velocities in the general manner of a circular saw while simultaneously moving relative to the polymer film;

(d) slit cutting, i.e. when a sharp edge of a blade is contacted with an unsupported polymer film.

All of the above cutting modes require a relative linear movement between the polymer film and the edge at the cutting point; such relative linear movement is critical in the sense that no continuous cutting occurs in the absence of such movement, and will be termed "primary cutting motion" herein. Another or secondary motion may be superimposed upon the primary motion. For example, a common shear with its blades somewhat opened may be moved relative to a polymer film and cuts the latter without the usual secondary motion of opening and closing the shear.

Accordingly, it will be appreciated that press cutting and shear cutting may include a secondary cutting motion, e.g. rotation of a circular knife, in addition to the primary motion or linear movement; rotational cutting, by definition, includes both primary and secondary motion while slit cutting involves but primary motion.

Most devices used for continuous longitudinal cutting of polymer films are those developed in the paper industry, i.e. press cutting or shear cutting devices comprising rotatable circular knives which, in press cutting, are pressed onto a counter-roller having an extremely hard surface or, in shear cutting, cooperate with a second rotatable circular knife to form a shear edge; in either case, the circular knives used must be of a rugged construction, i.e. have a substantial thickness of several millimeters to support the stresses of coacting with the support roller or the second knife.

Circular knives for rotational cutting must be suitable for cutting at relatively high speeds of typically above 1000 RPM and require a rigidity that cannot be achieved with a blade thickness below the millimeter range.

In general, previous devices for longitudinal continuous cutting of polymer films have performed satisfactorily with many conventional polymer films; however, there is a growing tendency to include various additives in polymer films to improve or modify certain properties and some typical additives are very abrasive. As a consequence, rapid and, sometimes, uncontrolled dulling of the knives becomes a problem of increased importance.

The possibility of counteracting the abrasive action of polymer film additives by improving performance properties of conventional knives is limited, however, both for reasons of costs of material and maintenance. In this connection, the use of discardable knives has been considered and attempts have been made to use such easily replaceable blades, such as conventional razor blades of the type used in safety razors; the usable cutting life of such blades is limited, however; controlled placement of fresh edge portions into cutting position is difficult, if not impossible, in an automated arrangement and blade utilization is low.

OBJECTS OF THE INVENTION

Therefore, it is a primary object of the invention to provide for an improved cutting device for cutting a polymer film, preferably in continuous movement, with an easily replaceable blade so as to permit controlled placement of fresh cutting edge portions of the blade into film-cutting position as well as improved utilization of the blade.

Another important object of the invention is to provide for automated positioning of fresh cutting edge portions of an easily replaceable blade into film-cutting position.

Yet a further object of the invention is to provide for automated replacement of used cutting edge portions by fresh cutting edge portions of a blade when a predetermined period of cutting life has been reached.

Still another object of the invention is a novel indexing blade for cutting polymer films and a cutting device incorporating such a blade.

SUMMARY OF THE INVENTION

According to the present invention it has been found that these objects will be achieved by means of a novel type of blade meeting certain requirements as explained in detail below and being referred to herein as an "indexing blade".

Surprisingly, it has been found that very thin and generally circular (including polygonal) discs of steel sheet can be used as indexing blades even though the thickness of the disc is in the same order of magnitude as the thickness of the polymer film. This is in marked contrast with conventional knives where the blade thickness is many times greater than the thickness of the polymer film.

Thus, according to a first embodiment, the invention provides for a method of cutting a polymer film, e.g. in the form of a web, by a relative linear movement between the film and a cutting edge in a film-cutting position, preferably, the linear movement is that of the web; the film has a thickness in the range of from about 10 micrometers to about 500 micrometers (μm) and the method is characterized by the steps of:

(A) providing the cutting edge as a substantially continuous edge at the periphery of a circular or polygonal steel steel sheet disc having a thickness in the range of from about 10 μm to about 500 μm preferably in the range of from about 20 μm to 300 μm and a diameter in the range of from about 10 millimeters to about 100 millimeters (mm), preferably in the range of from about 20 to 60 mm;

(B) maintaining the disc for a first and preferably predetermined length of cutting operation in a first position where a predetermined first incremental portion, e.g. 1° to 10° of a 360° periphery, of the cutting edge is in film-cutting position;

(C) indexing (synonymous with "step-switching") the disc for removing the first incremental portion of the cutting edge from the film-cutting position and for moving a subsequent incremental portion, preferably of the same size as the first portion, of the cutting edge into film-cutting position and maintaining it there for another and preferably predetermined length of cutting operation; and (D) repeating step (C) until a major part, at least, and preferably all of the continuous edge of the steel sheet disc has been indexed, i.e. until the disc has completed nearly a 360° turn about its central axis.

Of course, indexing should be discontinued before the first incremental edge portion in step (B) reverts into cutting position, with subsequent replacement of blade.

According to another embodiment, the invention provides for an indexing blade suitable for web-cutting and consisting essentially of a steel sheet disc having:

(a) a substantially uniform thickness in the range of from about 10 micrometers to about 500 micrometers, preferably 20 to 300 μm, (b) a diameter in the range of from about 10 millimeters to about 100 millimeters, preferably 20 to 60 mm, and (c) a substantially continuous cutting edge extending around the periphery of the steel sheet disc.

Generally, a Rockwell C hardness of at least about 50 is preferred for the disc.

According to a third embodiment, the invention provides for a web-cutting device comprising:

(I) an indexing blade consisting essentially of a steel sheet disc having (a) a substantially uniform thickness in the range of from about 10 micrometers to about 500 micrometers, preferably 20 to 300 μm, (b) a diameter in the range of from about 10 millimeters to about 100 millimeters, preferably 20 to 60 mm, and (c) a substantially continuous cutting edge extending around the periphery of said steel sheet disc;

(II) an indexing or step-switching actuator, such as a stepping motor, in operative connection with the disc, and (III) a mounting means for holding the indexing blade in a web-cutting position.

DISCUSSION OF PREFERRED EMBODIMENTS

While step-switching of the steel sheet disc may be actuated manually and controlled or limited to a defined step length, for example by a ratchet-type arrangement, use of automated actuators, such as a conventional step-motor is preferred for many purposes of the invention.

Normally the "size" of the indexing steps will determine the lengths of the incremental edge portions of the disc moved successively into cutting position after each edge portion has remained therein for a length of cutting operation. With a given diameter of the disc as defined above, the step size can be defined in terms of angular degrees of a circle that encompasses 360°.

Theoretically, when a polymer film held in a plane, such as a web, is relatively moved against a cutting edge held normally to the plane, the actual cutting position or first interaction between polymer film and cutting edge is a line on top of the cutting edge, the length of that line being defined by the film thickness, as the cutting edge is assumed to have virtually no "thickness". Thus, the minimum length of the incremental cutting edge portions required in steps (B) and (C) of the inventive method is the thickness or gauge of the polymer film (10 to 500 μm). In practice, a moving web of polymer film may deviate somewhat from its theoretical plane of travel so that the location of the film-cutting position (or first point of contact between polymer film and cutting edge) may deviate somewhat from its theoretical position; the length of each incremental portion of the cutting edge will, typically, be in the range of from about 0.5 to 5 mm, preferably about 1 to 4 mm.

As the peripheral length of a circular disc having a diameter between 10 mm and 100 mm will be in the range of from 31 to 314 mm, it is apparent that discs of such diameters will provide up to several hundred incremental edge portions for use in the cutting position. For many purposes and with disc diameters in the preferred range of form 20 to 60 mm, each indexing step will involve changing of the angular position of the disc (viewed normally to the disc plane and with 360° for full turn) by shifting the angular position of the disc in steps of from about 1° to about 10°; typically, the disc thus provides from about 30 to about 300 discrete portions of the cutting edge that can be used in succession in the cutting position until the blade is exhausted.

The term "length of cutting operation" could be quantified in terms of the geometrical length of the polymer film that has been cut; in practice, the length of the cutting time period is more convenient, notably as the speed of the web is frequently defined by a producing or processing plant where continuous cutting is required. For example, on such a time basis ("length of cutting operation" expressed in terms of "period of cutting time") an incremental cutting edge portion of an indexing blade according to the invention having a Rockwell hardness C of at least 50 will have a cutting life in continuous operation in the order of, for example, from 100 to 2000 minutes with typical web speeds (10 to 150 meters/minute, e.g. 20 to 80 meters/minute) at film gauges in the 50 to 500 μm range and with various polymers containing abrasive additives.

Thus, a typical indexing blade according to the invention will have a cutting life in the range of days to weeks and some simple tests will be sufficient to establish optimized use periods for the incremental portions and the indexing blade.

Preferably, the length of the cutting operations is monitored, e.g. on a time basis or on the basis of the cut web length, for generating signals that can be used to automatically control the indexing "frequency", i.e. the operational distance between subsequent changes of the angular blade position.

For example, the above values of cutting life periods of 100 to 2000 minutes per incremental edge portion would indicate a typical indexing frequency range of 14 indexing steps per 24 hours to 5 indexing steps per week of continuous operation.

While these examples of suitable indexing frequencies are given for illustration, the virtual infinity of variations in the polymer material-plus-additives systems may make it advisable to optimize the indexing frequency. In practice, indexing periods of below 50 minutes (between two subsequent shifts) will be the exception, while periods well above 1000 minutes have been found to be operable in many instances.

Visual inspection of the cut edges of the film will show when a cutting edge portion is becoming blunt by the appearance of undulations, stretch-orientations and irregular ruptures. So, when optimizing operation with the indexing period between putting the first incremental edge portion into cutting position and the first appearance of undulations and/or stretch-orientations. This period might typically be in the of several hundred minutes and a portion, say 50 or 75% or higher, say up to 90% of that period might be selected for the time length of each interval between subsequent indexing motions.

Starting operation with a fresh, i.e. sharp indexing blade according to the invention, such blade will be "exhausted" or "blunt" upon completion of a full indexing cycle and will be replaced by another fresh indexing blade.

To warn operating personnel of the approaching end of an indexing cycle of a blade, various optical or acoustic signals can be used; preferably, the indexing actuator, e.g. step-motor, is geared to produce or trigger such signal.

In general, replacement of an exhausted indexing blade should be simple and, preferably, entail no substantial effort for demounting and remounting of the blades. To that end, a blade support member for easy blade exchange may be provided on the indexing actuator, e.g. a magnetic plate and positioning means on the support member and/or the blade; preferably, the blade is provided with at least one perforation for cooperating with at least one corresponding protuberance, e.g. a pin or the like, on the blade support. As the indexing blade must be refrained from rotating, such positioning means can serve as a lock for preventing blade rotation.

Exhausted blades might be reconditioned by grinding. However, in view of the very small quantities of blade material used it is generally preferred to discard an exhausted indexing blade.

In general, the continuous cutting edge of indexing blades according to the invention should be substantially as sharp as the cutting edge of conventional razor blades of comparable thickness. As the production of razor blades is a highly developed and mature art, it is believed that the term "provided with a razor-type edge" provides for a clear definition in the subject context; it should be noted, however, that while providing steel sheet in the required thickness range with a razor edge is known per se, circular (including polygonal) indexing blades meeting the above specification and having substantially continuous razor-type edges are believed to be novel.

Consequently, novel indexing blades according to the invention can be manufactured by conventional grinding and honing techniques but starting from circular (including polygonal) pieces of steel sheet meeting the required thickness and shape parameters, and further providing a finished hardness of at least about 50 RHC, e.g. 55 to 58 RHC.

It has been found, according to the invention, that the novel indexing blades used in the method disclosed herein provide for surprising advantages in view of cost and operation. While not wishing to be bound by any theory, it is believed that these advantages are due, at least in part, to (a) a cutting mode based entirely on primary (linear) motion, thus avoiding spreading of the cut edges of the polymer film in directions normal to the plane of the film as would be the case if the blade were rotated; obviously, the indexing motion has no cutting effect of its own;

(b) a blade thickness in the same range of magnitude as the thickness of the polymer film; this seems to minimize spreading of the cut edges of the polymer film in directions parallel to the plane of the film;

(c) blade flexibility combined with substantial stability of shape.

In connection with stability of shape it should be noted that blade thickness and blade diameter preferably are correlated to avoid blade fluttering when used with a polymer film of a given thickness; for that reason, a blade thickness range of from 20 to 600 μm, more preferably of from 30 to 300 μm, and particularly of from 50 to 200 μm, is preferably combined with a diameter range of from about 20 to 60 mm. For many purposes, a diameter: thickness ratio of the indexing blades in the range of from about 100:1 to 3000:1 is suitable. Disc diameters below about 20 mm have the disadvantage of providing relatively few incremental cutting positions and diameters below 10 mm are not suitable for that purpose. On the other hand, at diameters of above 60 mm, an increased fluttering tendency may occur; this may be compensated by increasing the thickness within the limits given.

Generally, the disc thickness—primarily geared to minimize film spreading upon and immediately after cutting—may have an impact upon blade fluttering in the sense that lower blade thicknesses tend to increase the fluttering tendency. For that reason, a blade thickness in the lowest part (10 to 30 μm) of the range given is not preferred and a minimum blade thickness of at least 50 μm is a more preferred lower limit. At the uppermost part (300 to 500 μm) of the blade thickness range fluttering is avoided but the blade may be too thick so that blade thicknesses in this uppermost region are not generally preferred and a preferred upper limit of blade thickness is 300 μm and even a blade thickness of below 200 μm wi11 be suitable for most purposes of the invention, notably in the preferred diameter range.

Blade fluttering may, of course, depend upon the speed of the relative motion between the film and the blade. For many purposes and notably for continuous longitudinal web cutting, e.g. for tube slitting (opening of extruded polymer hose at one or both sides of the flat hose), margin cutting or web division in longitudinal or machine direction, it is preferred that the cutting edge is stationary while the web moves. Of course, such types of cutting require a substantially continuous operation and may involve relative cutting speeds (i.e. web speeds) in the typical range given above (10 to 150 m/min).

It is within the invention, however, to use the indexing blade for discontinuous cutting operations, e.g. for cutting a web transverse or oblique to the machine direction, for example in automated winders; for such purposes, the fixed blade (on a suitable support) could be moved in a given indexing position so that a particular incremental portion of the blade edge cuts the web. Because of the relatively small length of such transverse cuts, the operative cutting life of each increment will be much higher than in continuous (longitudinal) web cutting and indexing frequencies of one shift per day or week may be sufficient for assuring use of a perfectly sharp blade edge increment. In such cases, manual actuation may be quite sufficient, say one indexing step at the beginning of each day or shift as part of the start-up or take-over routine.

The term "polymer" is used herein to encompass webs or web portions of polymer films and comparable organic materials; generally, this implies a generally "flat" structure as is typical for moving webs of films in the plastics industry; this includes laminates in the thickness range given.

While the inventive indexing blade or cutting device comprising such blade may be of use in paper web cutting an/or metal film cutting, it is believed that its main advantages will be most important in polymer film or web cutting. Representative but non-limiting examples of polymer films or webs for use in the inventive method include single-layer webs and multi-layer webs provided that the total web thickness does not substantially, say by more than 20%, exceed the 500 μm upper thickness limit. Webs in the form of tubular extrudates preferably are cut, after local spreading of mutually superimposed web layers if required, in single-layer mode; generally, the single-layer mode is preferred even though the "single layer" may be a laminate.

The lower limit of the film thickness range (10 μm) is due mainly to practical reasons, such as lack of cohesiveness and self-supporting strength of extremely thin films.

"Polymer" includes homopolymers, copolymers, polymer mixtures and polymer compositions containing non-polymeric constituents, e.g. additives, dyes, plasticizers, etc. Illustrative examples of suitable polymers are polyolefins (e.g. polyethylene, polypropylene) including copolymers of such olefins (e.g. copolymers of ethylene and acrylic acid or vinyl chloride) and the so-called ionomers; polyhaloalkylenes, polyesters, polyamides; polyacrylates, polymethacrylates, polystyrene and styrene-based copolymers, polyvinylidene chloride, polyvinylidene fluorides, etc.

When using films of polyvinyl chloride (PVC) or similar materials that have a variable degree of plastification in a relatively "hard" form, the optimum upper limit of film thickness may be substantially below 500 μm. For example, films of hard PVC (shore A hardness of 90 or more) can be cut best when having a thickness of about 50 μm.

In general, polymer films suitable for use in the inventive method have a shore hardness (A, C or D) of up to about 90 or less and a ball-pressure hardness (German Industrial Standards DIN, in kg/cm$^2$) of up to about 1000 or less. Most thermoplastic polymers are suitable but films of regenerated cellulose, of chemically modified cellulose and of partially cross-linked polymers and the like are suitable as well as long as the films made thereof have a sufficient flexibility for processing as webs and have a hardness in the range just cited.

Additives including abrasive types such as anti-blocking agents, can be incorporated into the films; in fact, problems of continuously cutting such films with conventional cutting devices operating in the press-cutting, shear-cutting or rotation-cutting mode can be avoided entirely according to the invention by simply adapting the indexing frequency so that web ruptures, irregular edges and the like disadvantages of blade dulling do not occur.

Even if the films contain substantial amounts of abrasive anti-blocking agents, a typical indexing blade according to the invention will permit continuous cutting for periods of days to weeks.

BRIEF DESCRIPTION OF THE DRAWINGS

The invention will be better understood and objects other than those set forth above will become apparent when considering the following detailed description thereof. Such description makes reference to the annexed drawings, wherein.

Figure 1A:
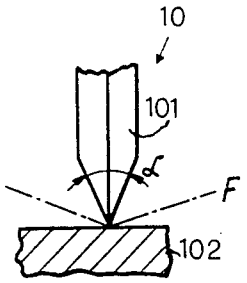
FIGS. 1*a* and 1*b* are diagrammatic illustrations of film cutting blades according to the art.

The prior art cutting device 10 of FIG. 1*a* comprises a circular knife 101 (shown in front view, upper portion broken away) rotatingly supported by a shaft (not shown) and in pressing engagement with an extremely hard rotating anvil or counter roller 102 (only a fragment being shown in section). This is an example of the press-cutting mode where the cutting edge angle $\alpha$ of circular knife 101 typically is well above 10°. A substantial thickness is required, of course, for knife 101.

The plane of the film that is cut is indicated as F in all Figures, that plane being assumed to extend normal to the plane of drawing, at least at the cutting point.

If the anvil 102 is omitted in the device of FIG. 1*a* and if the knife 101 is connected with a drive to rotate at, say, 1000 to 5000 rotations per minute, this would illustrate the rotation cutting mode.

Figure 1B:
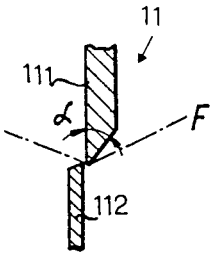

A conventional shear-type cutter 11 is illustrated in FIG. 1*b* comprising an upper rotating circular knife 111 (fragment shown) that cooperates with a lower rotating circular knife 112 (fragment shown) to form an endless shearing edge. This is an example of the shear-cutting mode and, again, the knife edge angle $\alpha$ would be substantially greater than 10°.

Figure 1C:
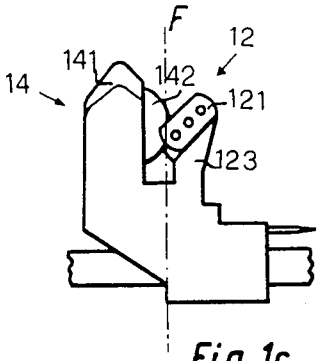
FIG. 1*c* is a diagrammatic illustration of a razor blade cutter shown for comparative purposes.

FIG. 1*c* illustrates, for purposes of comparison, a cutting device 12 using a conventional razor blade 121. Such blades are known to have many uses other than for shaving and various devices for cutting with such blades are conventional; thus, FIG. 1*c* is intended to show the resulted of using such blades for continuous cutting of polymer films. To this end, razor blade 121 can be arranged on a magnetic support 123 that holds blade 121 in cutting position and provides for easy replacement of used blades. A film-guiding means including, if desired, a spreader 141 and a guide member 142 cooperates with blade 121.

Operation of device 12 of FIG. 1*c* illustrates the slit cutting mode; physical contact between blade 121 and guide member 142 should be avoided as blade 121 has the thickness of a conventional razor blade, i.e. in the range of from about 40 to 100 $\mu$m, and is much too flexible for co-acting effectively with an anvil, counter-knife or the like counter-members used in press-cutting and shear-cutting.

Generally, film guide means are preferred for slit cutting operation, notably when using this cutting mode for one-sided or two-sided splitting of tubular films produced by blow-extrusion methods of the type disclosed, for example, in U.S. Pat. No. 2,668,323 to Johnson.

Returning to razor blade 121 of the device shown in FIG. 1*c* it is apparent that, as such blade has two parallel cutting edges, the practically feasible way of exchanging a blunted cutting edge of blade 121 is to reverse blade 121. Thereafter, a fresh blade is needed. In theory, each cutting edge of blade 121 might be used in incremental portions by manual displacement but with little or no positional control; in practice, this is impossible, however.

Figure 2:
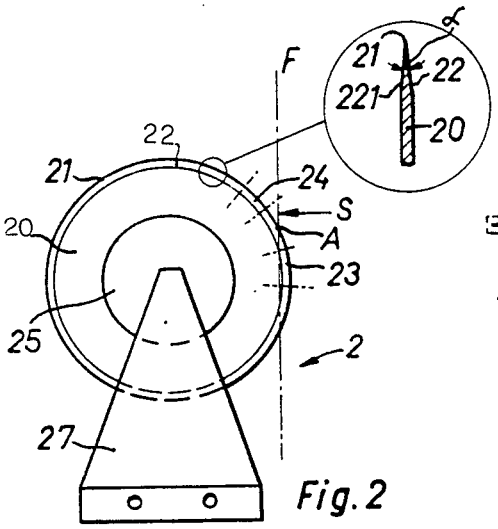
FIG. 2 is a diagrammatic side-view of a preferred embodiment of the invention having a circular indexing blade.

The device 2 shown diagrammatically in a side-view in FIG. 2 comprises an indexing blade in the form of a circular steel sheet disc 20 having a diameter of 45 mm and provided at its periphery 21 with a continuous or endless cutting edge 22. An enlarged portion of the peripheral part of disc 20 is shown in section in the circle connected with FIG. 2: steel sheet disc 20 having a substantially uniform thickness of about 200 $\mu$m and a Rockwell hardness C in the range of from 50 to 58 presents a razor-sharp edge formed by two converging edge surfaces 22, 221 obtained, e.g. by grinding and honing.

Surfaces 22, 221 are shown to be "planar", i.e. presenting a linear taper, but could be slightly curved, i.e. form a cutting edge with a concave taper or a convex taper as can be obtained by grinding and honing techniques conventionally used in production of razor blades. The angle $\alpha$ enclosed by surfaces 22, 221 in a linear taper will generally be below 10°, e.g. 8° to 9°. Typically, the radial length of surfaces 22, 221 will be about 4 to 6 times greater than the thickness of disc 20, regardless of the type of taper.

For indexing or step-switching, steel sheet disc 20 is rigidly connected with a step-switching actuator 25 (indicated in FIG. 2 diagrammatically as a circle) that may be a ratchet (two adjacent discs having interlocking toothed surfaces and pressed together by a spring) or, preferably, a stepping motor. Such motors, generally for electrical operation, are conventional in the step-switching art and provide for a predetermined angular displacement of an axis in response to a signal.

Actuator 25 is, in turn, rigidly connected with a mounting plate 27 or equivalent mounting means for holding the indexing blade 20 in a web cutting position. The web plane is indicated by line F and is assumed to be normal to the plane of drawing moving continuously in a "downward" direction, i.e. downwards from the upper side of FIG. 2, and the indexing blade is kept stationary, both in planar and in axial direction once the position of mounting plate 27 is fixed, e.g. after moving into a desired position by sliding displacement on two rods (not shown) mounted on the frame of a web-processing machine (not shown) and securing in that position.

The web-processing machine might be a group of web-moving rollers, connected with a blown-hose extruder, a web-winding apparatus, a coating machine or the like requiring continuous longitudinal slitting or trimming of a polymer web.

Three mutually adjacent incremental portions of cutting edge 21 are indicated between broken lines of FIG. 2 and designated by "A" and reference numerals 23, 24. The radial lengths of the incremental portions are exaggerated in FIG. 2 for clarity and would, in practice, cover only about 3° to 6° of the total 360° periphery.

Assuming that cutting of the downwardly moving web F is started when portion A of indexing blade 20 is in cutting position as depicted in FIG. 2 and further assuming a typical speed of movement of web F of about 30 meters per minute: now, portion A will be held in cutting position as long as that portion remains sufficiently sharp for smooth cutting of web F. Depending mainly upon the abrasive effect of web F (e.g. its anti-blocking constituent and proportion thereof), it may typically take about 500 minutes of cutting time (i.e. 15,000 meters of cutting length) until incremental edge portion A begins to loose its original sharpness by continued abrasion. Accordingly, a predetermined and safe (for continued smooth cutting) length of cutting operation would be about 250 minutes of cutting time or 7500 meters of cutting length with an abrasive film.

This length may be determined by previous runs (operating instructions) or by a simple test run when a hitherto untried web material is to be cut.

The predetermined value for a safe length (time-wise or length-wise) of cutting operation is used as a first or "step-trigger" indexing parameter, i.e. to trigger actuator 25. An example for a suitable triggering arrangement will be given below.

When actuator 25 is triggered, it will move an adjacent and fresh incremental portion of cutting edge 21 into cutting position. Assuming that the sense of operation of actuator 25 is anti-clockwise, the subsequent incremental portion indexed into the original position of A is cutting edge portion 23 which now remains in that position for the above explained safe cutting time or length of 250 minutes or 7500 meters and will be indexed out of cutting position by actuator 25 thereafter.

Thus, a continuous cutting operation can be maintained until the "last" fresh incremental portion 24 is indexed into cutting position A.

As will be understood from the explanation, a second indexing parameter is required that in effect determines the cutting life of the indexing blade, i.e. the number of indexing steps per full periphery of 360°. This second parameter, in effect, determines the peripheral length of each incremental cutting edge portion, and while this length is dependent both upon the diameter of indexing blade 20 as well as upon the angular displacement of actuator 25 per switching step, it will be termed "angular" indexing parameter.

An actual peripheral length of each incremental cutting edge portion of about 1 mm will be sufficient for many cutting purposes and this length may be doubled if required for safety of continuous cutting, e.g. to compensate for minor deviations of the web from its theoretical plane of movement. Accordingly, the 45 mm diameter of indexing blade 20 having a peripheral length of about 140 mm may provide for 140 or 35 incremental portions corresponding with angular indexing parameters of 2.5° or 10°. Accordingly, the actuator 25, or its variable setting, will have to provide for indexing blade 20 by 2.5° or 10° per step in this example. As conventional indexing actuators such as stepping motors provide for control, no further explanation is believed to be required here.

By the same token, generation of a signal that indicates complete or substantially complete indexing of blade 20 can be achieved by conventional means, e.g. standard design of stepping motors or stepping motor control. For example, when the "last" incremental edge portion 24 is indexed into position A, a contact in the actuator that is activated once per full turn, may close a circuit that powers an optical of acoustical warning device such as a bell; for additional safety, a timer triggered in the same manner may interrupt operation of the machine that produces or moves web F.

For safely guiding web F into the cutting position A of FIG. 2, it may be advantageous to provide for a web-guide that supports web F, e.g. in the position marked S. Depending upon the conformation of F, the support at S may have a plane or a curved surface. A physical contact between the web-guide at S and indexing blade 20 should be prevented, however.

Figure 3:
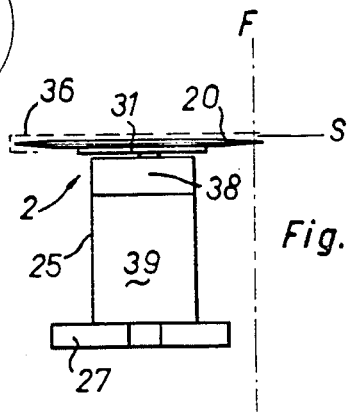
FIG. 3 is a diagrammatic top-view of the device shown in FIG. 2.

A top-view of device 2 of FIG. 2 is shown in FIG. 3 to illustrate that a generally normal position of indexing blade 20 relative to web F is preferred. It should be emphasized, however, that only that portion of web F at the cutting position A need be so oriented.

As apparent from FIG. 3, a protecting shield 36 may be used for operating safety. Further, the indexing actuator or stepping motor 25 is shown to consist of a drive 39 and reduction gear 38; further, blade 20 is connected with gear 38 by a support plate 31 that may have one or more positioning pins (not shown) matching with corresponding perforations (not shown) of indexing blade 20.

For a convenient exchange of a used indexing blade by a fresh blade, support plate 31 is a magnetic plate.

Figure 4:
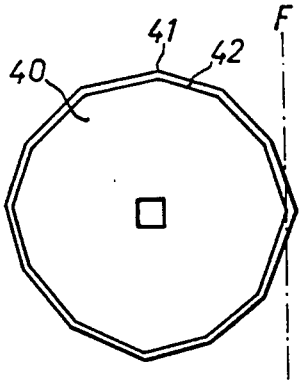
FIG. 4 is a diagrammatic view of a polygonal indexing blade according to the invention.

While indexing blade 20 of FIGS. 2 and 3 is shown to be circular in accordance with a preferred embodiment, FIG. 4 illustrates a "substantially circular" indexing blade 40 in a polygonal (regular polygon) shape; preferably, the continuous cutting edge 42 at periphery 41 of blade 40 is subdivided to present at least twelve, and preferably more than twelve, linear segments, for example twenty-four or thirty-six segments. In general, one segment should be provided for each indexing step.

Figure 5:
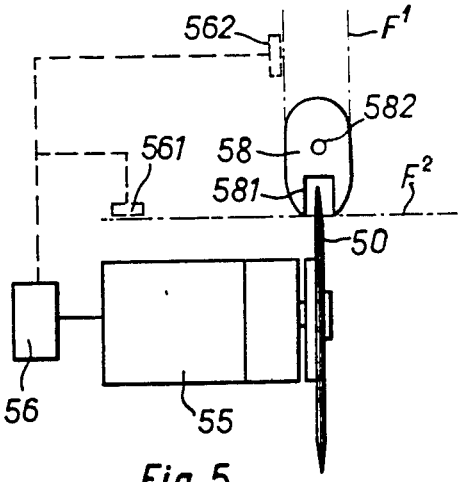
FIG. 5 is a diagrammatic top-view of an inventive device comprising a film-guiding means.

FIG. 5 indicates, in a diagrammatic top-view, two different positions of indexing blade 50 relative to two polymer film webs $F^1$, $F^2$, each of which is guided in a typical conformation. Web $F^1$ shows a side or edge portion of a normally compressed tubular film of the type produced by extrusion and subsequent inflation ("blow-extrusion") of the type mentioned above. Web $F^2$ is moved in planar conformation normal to blade 50.

In order to maintain web $F^1$ in a substantially normal position relative to indexing blade 50 in the area of the cutting position, a film or web guide 58 is held in a stationary position, e.g. by being secured to the same mounting means (not shown) that holds actuator 55 and blade 50. Guide 58 has a recess 581 to receive blade 50 without contacting same, and air outlet 582 for blowing air into tubular web $F^2$ so as to facilitate spreading thereof. This is particularly advantageous when cutting up tubular films of very thin or rupture-sensitive polymer films. In practice, tubular films in an originally compressed or folded state will be cut up in two portions, e.g. at each folding edge, so that a pair of cutting devices will be used.

A similar guide 58 (minus air outlet 582) can be used to guidingly support a web $F_2$, moved in a generally planar configuration, at or near positions S indicated in FIGS. 2 and 3.

Indexing blade 50 and actuator 55 of FIG. 5 correspond with blade 20 and actuator 25 of FIGS. 2 and 3 and an actuator control 56 is shown to supply a triggering signal or impulse to actuator 55 in accordance with the first or step-triggering indexing parameter explained above.

Actuator 56 may be a timer device connected, if desired, with the drive (not shown) of the web producing or web processing plant. Alternatively, or complementary, the actuator control 56 may be connected with a conventional device 561, 562 for metering the length of a moving web so as to adapt the indexing frequency to a change of the speed of web movement.

Figure 6:
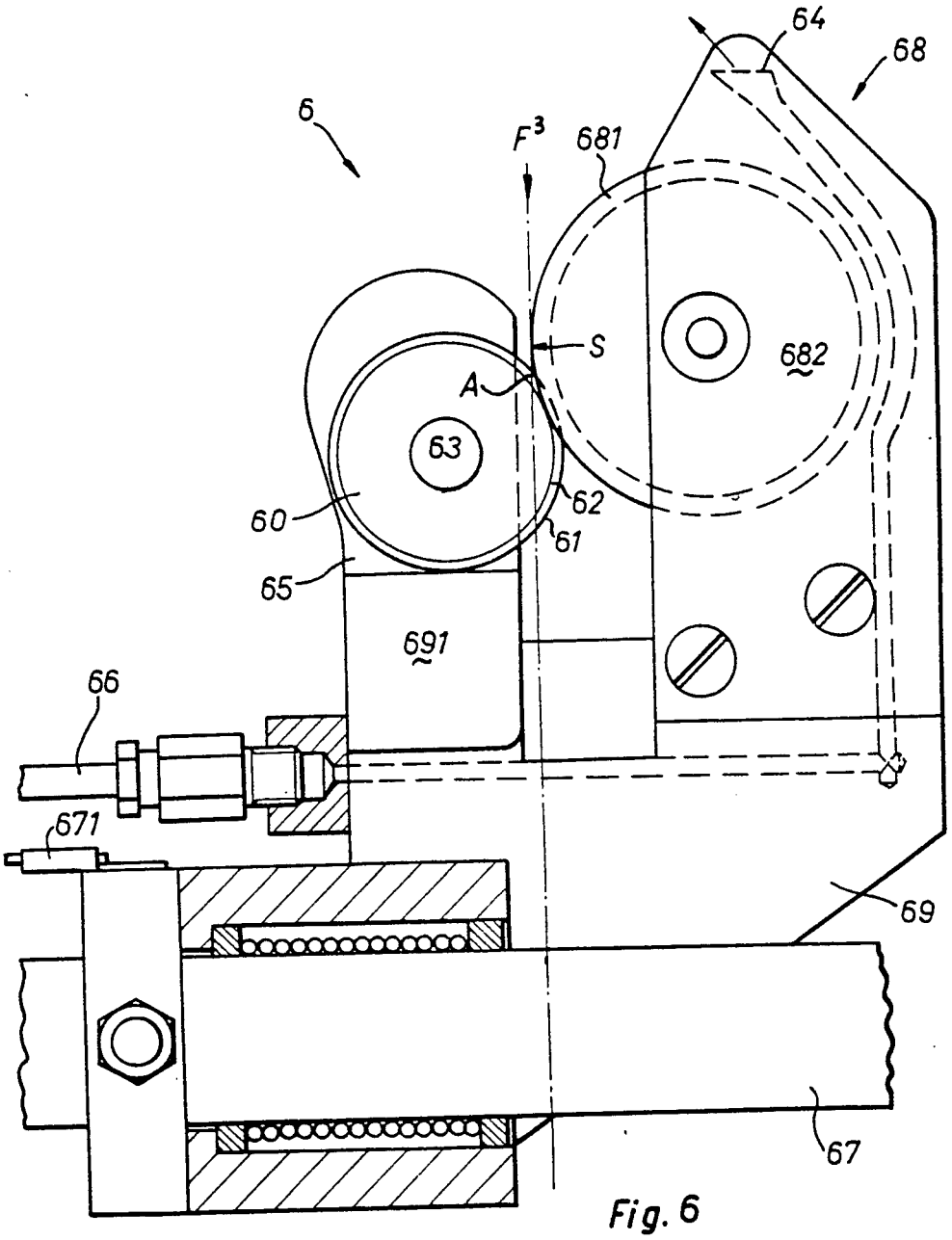
FIG. 6 is a semi-diagrammatic side-view of an inventive device in operative position on a machine used in the production of films by blow extrusion.

A cutting device 6 according to the invention is shown in FIG. 6 in a semi-diagrammatic side-view, partially sectioned. Indexing blade 60 is a steel sheet disc having a uniform thickness of 100 to 300 μm and a diameter of 30 to 60 mm. A continuous cutting edge 62 is provided at periphery 61 of blade 60 and a securing member 63 holds blade 60 in rigid connection with actuator 65 which is mounted on support 691 of slide-carriage 69.

Carriage 69 is slideably mounted on a guide bar 67 of a web processing machine (not shown); rod 671 connected with carriage 69 is used to slightly pull the spreader device 68 towards the inner surface of one edge $F^3$ of a tubular film moving in downward direction. It is to be understood that rod 671 carries a second device 6 (not shown) in opposite position at the other edge (not shown) of the tubular film extending from $F_3$ and beyond the right side of FIG. 6.

Spreader 68 is provided with an air-outlet 64 supplied with compressed air via line 66 and bores (broken lines) within carriage 69.

A free-wheeling circular film guide 682 having a peripheral recess 681 for receiving an edge portion of indexing blade 60 but without contacting the latter in the same general manner as explained in connection with FIG. 5 is provided so that edge $F^3$ of the tubular film will be guided into cutting position A.

Again, as explained above, indexing blade 60 is not moved except when indexed for removing an incremental portion of cutting edge 62 from cutting position A and for introducing a fresh subsequent incremental cutting edge portion into that position. Again, each incremental portion of cutting edge 62 will have a peripheral length in the range of typically 1° to 10° providing for 36 to 360 incremental edge portions for indexing into, and out of, cutting position A. With a typical residence time of each incremental portion of about 250 minutes in cutting position, the total cutting time of indexing blade 60 will be in the range of from 9000 to 90,000 minutes; as each indexing motion of the blade 60 is substantially momentary and, typically, lasts for a second only, the aggregated total time of indexing motion during complete indexing of blade 60 will amount from 36 seconds to 6 minutes and thus has no effect upon cutting. Accordingly, there is no appreciable difference if indexing is clockwise or counter-clockwise.

In general, indexing blades according to the invention can be obtained from sheets of tool-grade steel, e.g. steel sheets of the type conventionally used in the manufacture of razor blades. Typical examples are ferrous alloys containing carbon and chromium as the essential alloying elements. For example, a steel containing about 0.4%, by weight, of carbon and 13.5%, by weight, of chromium is illustrative but numerous other types of cutting-grade steel are known and can be used for the indexing blades disclosed herein.

Examples will be given to illustrate, but not to limit, the inventive method.

EXAMPLES I–IV

A polymer film producing plant was modified as follows: two indexing cutters 6 as illustrated in FIG. 6 were slidingly arranged on the frame-supported slide bar 67 of the withdrawing roller group of a conventional and commercially available blow extruder (type A 90-32, manufactured by AFEX AG of Uznach, Switzerland). The plant was set to produce a primary web in the form of a folded and compressed tubular film having a width of 1000 mm and at a web speed at slide bar 67 of 30 meters/minute for subsequent cutting-up at both lateral folding edges so as to produce two films, each having a width of 1000 mm.

The two cutters 6 were positioned on bar 67 so that each guide wheel 681 of guide 68 was in contact with the inner surface of one of the two folding edges.

The actuators 65 were commercially available standard stepping motors ("Saia-stepping motors", supplied by Saia AG of Murten, Switzerland ) comprising an electric motor, a gear and a dial for setting axial displacement per switch; a setting for 9° displacement was selected for both stepping motors. The electrical input to the stepping motors was controlled by the main power switch of the blow extruder so that the actuators 65 were operative only as long as the extruder was in operation.

The actuator control for each stepping motor was a commercially available standard timing switch (also supplied by Saia AG, Switzerland) with a dial to set a time interval between subsequent switching impulses. Setting of this dial was selected for the "safe length" time periods given in Table I below.

Each cutter 6 was connected at 671 with a weight-loaded (500 g) wire so that each guide wheel 681 was lightly pressed against the inner side of the corresponding folding edge of the tubular web. Compressed air was supplied via a flexible conduit connected with each cutter 6 at 66 to provide a continuous air stream of 2 to 5 liters/minute at the outlet end of nozzle 64.

Each indexing blade 60 had a diameter of 45 mm, a thickness of 200 μm and a Rockwell C-hardness of 56. Edge 62 was obtained by honing to razor blade sharpness.

The calculated length of each incremental edge portion was 3.53 mm. A standard counting device was connected with one stepping motor to activate a buzzer after 40 switches of that stepping motor.

A continuous winder as disclosed in U.S. Pat. No. 4,191,341, FIG. 7, was used to receive the two webs resulting from cutting up of the blow-extruded tubular film. The web-cutting quality was judged by visual inspection of the side faces of the coils obtained on the winder. The cutting quality was judged "good" when and as long as the coil side faces had a smooth and uniform appearance. The cutting quality was judged "poor" when the coil sides showed stratification due to irregularities at the film edges.

Films of polymers known to have low or high intrinsic abrasive effects on cutting devices and with or continuous operating conditions (three shifts per day) with continuous operation during 3 to 6 days.

When starting production with a given polymer composition, the actuator control was deactivated (Zero-setting) for observation of the time-dependence of the cutting quality, i.e. without indexing. The first appearance of irregularities at the coil sides indicated a "critical length" of the cutting operation per edge increment; 50 to 80% of that critical length (time-wise) was taken as the "preliminary safe length" and the actuator control was set at that value. When continued operation showed any indication of poor cutting quality, the "preliminary safe length" was further shortened. When a run was completed without indication of poor cutting quality, the last "preliminary safe length" was taken as "safe length".

The results are summarized in Table I together with the polymer systems used and show that the indexing blades performed well even with very abrasive systems requiring a blade exchange only after more than 150 hours of continuous cutting. In view of the low costs of such thin indexing blades and the simplicity of the blade-exchange operation, this provides for a marked improvement, both as regards cost and maintenance, over the best prior art shear or press cutting devices, notably when used for highly abrasive systems

TABLE I

| | | | Safe length of cutting operation per 9° edge increment of blade | | Total length of cutting operation of blade | |
|---|---|---|---|---|---|---|
| Example | Polymer System | Film gauge (μm) | cutting time (min) | cutting length (kilometers) | cutting time (hours) | cutting length (kilometers) |
| I | Polyethylene (low density) | 50 | 1440+ | 43.2+ | 960+ | 1782 |
| II | Polyethylene (low density) + 5% b.w. of pigment* | 50 | 720 | 21.6 | 480 | 864 |

TABLE I-continued

| Example | Polymer System | Film gauge (μm) | Safe length of cutting operation per 9° edge increment of blade: cutting time (min) | Safe length of cutting operation per 9° edge increment of blade: cutting length (kilometers) | Total length of cutting operation of blade: cutting time (hours) | Total length of cutting operation of blade: cutting length (kilometers) |
|---|---|---|---|---|---|---|
| III | Ionomer** | 50 | 720 | 21.6 | 480 | 864 |
| IV | Ionomer** + 2% b.w. anti-blocking agent*** | 50 | 240 | 7.2 | 160 | 288 |

NOTES:
*pigment was $TiO_2$;
**Ionomer was SURLYN (reg. Trademark, E. I. Du Pont de Nemours), types 1601 and 1603;
***Antiblocking agent supplied by E. I. Du Pont de Nemours under the trade name COMP Blade exchange operation with the invention device was timed to take from 7 to 10 seconds; a conventional shear cutter used for comparative purposes with the abrasive polymer system of Example IV requires knife-reconditioning after about one week of continuous operation; demounting and remounting of knife-reconditioning may take several hours.

Suitable modifications could be made to the system described here without departing from the inventive concept. So, while certain preferred embodiments of the invention have been explained in some detail for illustration, it is to be understood that the invention is not limited thereto but may be otherwise embodied and practiced within the scope of the following claims.

What I claim is:

1. A device for cutting a web of a predetermined thickness by a relative movement between said web and a cutting edge, comprising:

(I) an indexing blade consisting essentially of a steel sheet disk having (a) a substantially uniform thickness of the order of magnitude of said predetermined thickness of said web to be cut and in the range of from about 10 micrometers to about 500 micrometers, (b) a diameter directly varying in the range of from about 10 millimeters to about 100 millimeters with a variation in said substantially uniform thickness of the indexing blade in said range from about 10 micrometers to about 500 micrometers, and (c) a substantially continuous cutting edge extending around the periphery of said steel sheet disk, (II) an automatic indexing actuator in operative connection with said indexing blade, and (III) a mounting means for holding said indexing blade in a web cutting position.

2. The device of claim 1, wherein:

said automatic indexing actuator includes an indexing drive.

3. The device of claim 1, wherein:

said indexing blade has a substantially uniform thickness in the range of from about 20 micrometers to about 300 micrometers; and said substantially uniform thickness of said indexing blade varying in the range from 50 micrometers to 200 micrometers as the diameter of said indexing blade varies in the range from 20 mm to 60 mm.

4. The device of claim 1, wherein:

said automatic indexing actuator is operable during web cutting for indexing said indexing blade during such time as said cutting edge thereof is in cutting engagement with the web.

5. The device as defined in claim 1, wherein:

said indexing blade is formed in one piece.

6. The device of claim 1, wherein:

said indexing blade is located externally of the web.

7. The device of claim 6, wherein:

the automatic indexing actuator is located externally of the web.

8. The device of claim 1, wherein:

said indexing blade is connected with a support for removably holding said indexing blade in said connection with said automatic indexing actuator.

9. The device of claim 1, further comprising:

a metering means for generating signals indicative of cutting operation length and connection between said metering means and said automatic indexing actuator for controlling indexing of the indexing blade.

10. The device of claim 1 further comprising a device for indicating completion of an indexing cycle of said blade.

11. The device of claim 1, wherein:

said mounting means comprises a bracket for holding said indexing blade in a generally stationary film-cutting position for continuously cutting a moving web of a polymer film at a lateral web portion thereof.

12. The device of claim 11, further comprising:

means for guiding the moving web of said polymer film into said film-cutting position.

13. The device of claim 12, wherein:

said guide means includes means for spreading apart mutually adjacent layers of tubular polymer film of the moving web prior to the cutting operation.

14. A device for slit-cutting a moving polymer film having a predetermined thickness in the range of from 10 to 500 micrometers, comprising the combination of:

a step-switching motor;

a circular steel sheet disk removably connected with said step-switching motor and having a peripheral cutting edge;

means for mounting said steel sheet disk externally of the moving polymer film;

said step-switching motor being operable for maintaining a first fresh portion of said cutting edge in a position to cut a first predetermined length of said polymer film with said first fresh edge portion and to index or incrementally turn said sheet steel disk for providing a subsequent fresh portion thereof for cutting a subsequent predetermined length of said polymer film with said subsequent fresh edge portion until at least a major portion of said peripheral cutting edge has been indexed;

said steel sheet disk having a substantially uniform thickness of the order of magnitude of said predetermined thickness of said moving polymer film and in the range of from about 20 micrometers to about 300 micrometers and a diameter in the range of from about 10 millimeters to about 100 millimeters and which diameter directly varies with a variation in said substantially uniform thickness of said steel sheet disk in said range from about 20 micrometers to about 300 micrometers.

* * * * *